United States Patent [19]

Higgins et al.

[11] Patent Number: 4,707,692

[45] Date of Patent: Nov. 17, 1987

[54] ELECTROLUMINESCENT DISPLAY DRIVE SYSTEM

[75] Inventors: Marvin L. Higgins, Corvallis; Bill Eaton, Albany; Eugene A. Cooper, Scio; Clifford B. Cordy, Jr., Corvallis, all of Oreg.

[73] Assignee: Hewlett-Packard Company, Palo Alto, Calif.

[21] Appl. No.: 677,112

[22] Filed: Nov. 30, 1984

[51] Int. Cl.[4] ..... G09G 3/30

[52] U.S. Cl. ..... 340/805; 340/781; 340/811; 340/825.81; 315/169.3

[58] Field of Search ..... 340/781, 805, 811, 813, 340/765, 784, 825.81; 315/169.1, 169.3, 242, 246

[56] References Cited

U.S. PATENT DOCUMENTS

| | | | |
|---|---|---|---|
| 3,749,977 | 7/1973 | Sliker | 315/169.1 |
| 3,991,416 | 11/1976 | Byles et al. | 340/805 |
| 4,070,663 | 1/1978 | Kanatani et al. | 340/811 |
| 4,238,793 | 12/1980 | Hochstrate | 340/781 |
| 4,253,097 | 2/1981 | Hochstrate | 340/781 |
| 4,254,362 | 3/1981 | Tulleners | 315/169.3 |
| 4,349,816 | 9/1982 | Miller et al. | 340/781 |
| 4,485,379 | 11/1984 | Kinoshita et al. | 340/805 |

OTHER PUBLICATIONS

M. R. Miller & R. P. Tuttle, "A High-Efficiency Drive Method for Electroluminescent Matrix Displays" Proceedings of the SID, vol. 23/2, 1982, pp. 85–89.

"The AC Thin Film Electroluminescent Display" taken from Display Driver Handbook, 1983, Texas Instruments, pp. 2–33, 2–39.

*Primary Examiner*—John W. Caldwell, Sr.
*Assistant Examiner*—Jeffery A. Brier
*Attorney, Agent, or Firm*—Jeffery B. Fromm

[57] ABSTRACT

A resonant mode energy recovery circuit is disclosed for supplying drive pulses to an electroluminescent (EL) display arranged as a matrix of pixels addressed by a plurality of column and row electrodes. An external inductor is used to alternately store and supply energy from the column electrodes of the EL display which has an impedance equivalent to an array of capacitors and resistors. Switching transistors and diodes are used to start and stop the resonant current flow at ¼ wavelength intervals of the resonant frequency of the resonant tank formed by the external inductor and the array capacitors coupled to the column electrodes in order to form the pulses required to address the columns of the matrix. Switched current sources are used to start and stop nonresonant current flow to form the refresh and write pulses used to form the pulses required to address the rows of the matrix. Together, the pulses applied to the columns and rows of the matrix provide the high voltage necessary to light the EL pixels while minimizing the address time and power required to operate the EL display.

10 Claims, 9 Drawing Figures

413
415
λ
413
λ/4
410
405
402
λ
λ/4
400
+70V
0V
COL DRIVE
230
1.2A PEAK
RECOVER ENERGY
STORE ENERGY
RECOVER ENGERGY
L = 600 μH
$C_{LOAD}$-10 TO 210nF
.6A PEAK
$\lambda/4 = \frac{\pi\sqrt{LC_{LOAD}}}{2}$
WAIT FOR END OF DISCHMOCD TIME
STORE ENERGY
SMALL LOAD
LARGE LOAD
WAIT FOR END OF CHMOD TIME
400
0A
INDUCTOR 320
425
422
DEPENDS ON HOW MANY PIXELS ON IN A ROW
~50V
420
400
0V
ROW DRIVE
235
-80V
0
5
10
15
20
25
30
35
40
45
50
55
60
65
micro seconds

ELECTROLUMINESCENT DISPLAY DRIVE SYSTEM

BACKGROUND OF THE INVENTION

As shown in the "Display Driver Handbook", published by Texas Instruments, 1983, electroluminescent (EL) displays have recently attracted significant interest as an alternative to cathode ray tubes (CRT) as visual output devices in electronic systems. Unfortunately, because of the capacitive nature of EL displays as explained by Miller and Tuttle in "A High-Efficiency Drive Method for Electroluminescent Matrix Displays", Proceedings of the SID, Volume 23/2, pages 85–89, 1982, the power consumed by the overall display system is highly dependent on the circuitry used to drive the display.

Various schemes have been disclosed to provide drive circuits which are designed to match the capacitive characteristics of the EL displays. Miller et al. in U.S. Pat. No. 4,349,816 issued Sept. 14, 1982 have shown the use of a capacitive voltage divider circuit, while Hochstrate in U.S. Pat. No. 4,238,793 issued Dec. 9, 1980 and in U.S. Pat. No. 4,253,097 issued Feb. 24, 1981 has shown the use of LC resonant tank circuits with an oscillating drive to power the EL display elements in displays with very few matrix elements. Although each of these prior schemes is relatively efficient for driving an EL display, they suffer from several problems of their own such as being overly sensitive to variations in the capacitance of the EL display, requiring a relatively large number of individual capacitors which are difficult to fabricate as an integrated circuit, being impractical to realize when a large number of matrix elements (i.e., on the order of one hundred or more) is to be addressed, or being too slow to permit rapid activation (i.e., at 60–70 hertz) of the entire EL display when the display has a large number of matrix of elements.

SUMMARY OF THE INVENTION

The present invention provides a novel energy recovery circuit for supplying resonant mode drive pulses to an EL matrix display, while at the same time overcoming the disadvantages of the prior art. The circuit takes advantage of the characteristics of a resonant LC tank equivalent circuit without permitting the resonant tank to oscillate. An external inductor and capacitor along with the varying capacitance and resistance of the EL display form a resonant circuit with each of the lines connected to the columns of the display matrix. The external inductor is used to alternately store and supply energy from the display, and the external capacitor is used to minimize the effects of varying panel capacitance. Switching transistors and diodes are used to start and stop the resonant current flow at $\frac{1}{4}$ wavelength intervals of the resonant frequency in order to form pulses of a sufficiently high voltage to cause the display elements to emit light without permitting the display voltage to oscillate. In addition, since the resonant drive pulses which drive the columns of the display matrix are not permitted to oscillate the columns can be scanned at a higher rate than would be possible if the column voltages were allowed to oscillate at the natural frequency of the column circuits. Although resonant drive pulses can also readily be provided for the rows of the display matrix, typically this is not necessary because of the way in which large matrix EL displays are constructed and because of the way in which the EL display is driven in the present invention. Thus, nonresonant voltage pulses can be used for the rows of the display since the power lost in driving the rows of the display matrix is only a small fraction of the power lost in other elements of the overall system. The resonant column pulses and nonresonant row pulses are supplied to an entire row at a time of the display matrix via column and row multiplexers for each of the display elements which are to emit light.

Because the voltage pulses supplied to the display columns are at $\frac{1}{4}$ wavelength intervals of the resonant frequency of the display, any energy which is not used to produce light from the display elements or is not dissipated by the resistive component of the display leads is recovered by being stored in the output capacitor of the high voltage DC power supply which is present to provide the necessary EL threshold voltage. At the same time, because the voltage pulses which drive the display are not allowed to oscillate, but rather are clamped to the value of the high voltage DC power supply, the individual display elements can be scanned at a higher rate than is possible with an oscillating drive and the amount of light emitted from each display element is constant because the drive voltage being used is constant.

DETAILED DESCRIPTION OF THE INVENTION

Figure 1:
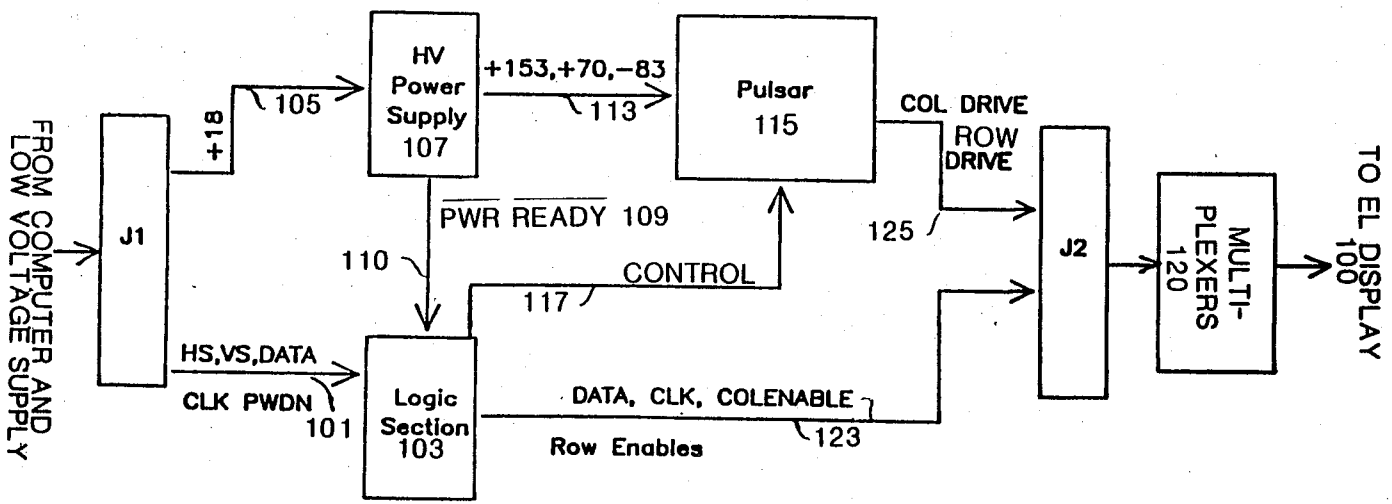
FIG. 1 shows a block diagram of a display drive system according to a preferred embodiment of the present invention.

FIG. 1 shows a block diagram of the circuits used to drive and control an EL display 100. A connector J1 receives logic information from a computer (not shown) and DC power from a low voltage power supply (not shown). The logic information is in turn transmitted via bus 101 to a logic section 103 which takes the logic information received from the computer and formats this logic information as needed to drive the EL display 100. The low voltage DC power is transmitted via bus 105 to a high voltage power supply 107 which provides the high voltage supplies necessary to cause the EL display 100 to emit light. The high voltage power supply 107 also produces a power ready signal 109 which is transmitted via bus 110 to the logic section 103. The power ready signal 109 is used to signal the logic section 103 that the high voltage supply 107 is ready to provide the power necessary to cause the EL display 100 to emit light. In the preferred embodiment, three high voltages (i.e., +153 volts, +70 volts, and −83 volts) are created by conventional power supply inverter techniques and transmitted via bus 113 to pulsar 115. The logic section 103 is also connected via bus 117 to the pulsar 115 so that the logic section 103 can provide the signals necessary to control the creation and timing of high voltage pulses by the pulsar 115 needed by the EL display 100.

Figure 2:
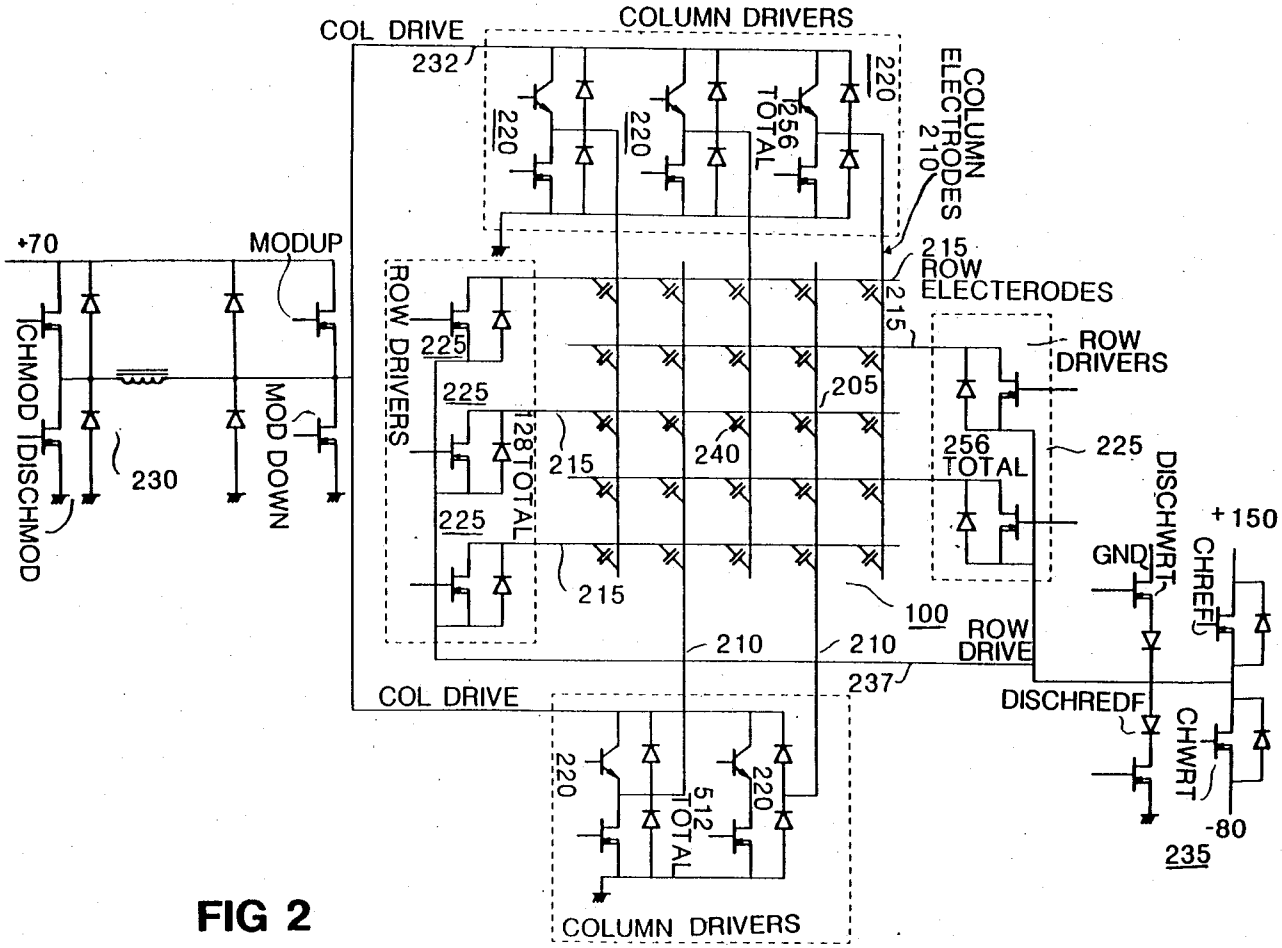
FIG. 2 shows a schematic representation of an EL display with a plurality of column and row drivers, a column driver circuit and a row driver circuit.

As shown in FIG. 2, the EL display 100 is arranged as a large matrix of light emitting elements 205, referred to as pixels. The individual pixels 205 are accessed via a plurality of electrodes arranged as columns 210 and rows 215 so that each pixel 205 can individually be turned on and off. In the preferred embodiment there are 512 columns and 256 rows which permit access to 131,072 individual pixels 205. Each of the column electrodes 210 is connected to a column driver 220, and each of the row electrodes 215 is connected to a row driver 225. Collectively, the column drivers 220 and the row drivers 225 make up multiplexers 120 as shown in FIG. 1. The multiplexers 120 receive logic signals from the logic section 103 via bus 123 and connector J2 and high voltage pulses from the pulsar 115 via bus 125 and connector J2.

Because of the use of multiplexers 120, only a single column drive circuit 230 and a single row drive circuit 235 are needed to provide high voltage pulses via column drive line 232 and row drive line 237, respectively, for the entire matrix of elements 205 as shown in FIG. 2. Both the column drive circuit 230 and the row drive circuit 235 comprise the pulsar 115 as shown in FIG. 1.

Each of the 512 column drivers 220 is either turned on or off for an entire row of pixels 240 all at one time as desired. This process is repeated over and over until each of the 256 rows of pixels 240 has been written. This is called "line at a time" scanning, as opposed to "dot at a time" scanning used in a CRT display. After the entire display 100 has been written with the desired pattern (i.e., after an entire "frame" has been written) it is necessary to reverse the polarity of the voltage on the pixels 240, so that each pixel 240 is driven by an AC pulse train The necessary reverse polarity voltage is called a refresh pulse and is accomplished by reversing the voltage on all of the row electrodes 215 for the entire display at once. Thus each pixel 240 which is lit is exposed to a complete AC voltage cycle going from +150 V to −150 V during each display frame.

Figure 3:
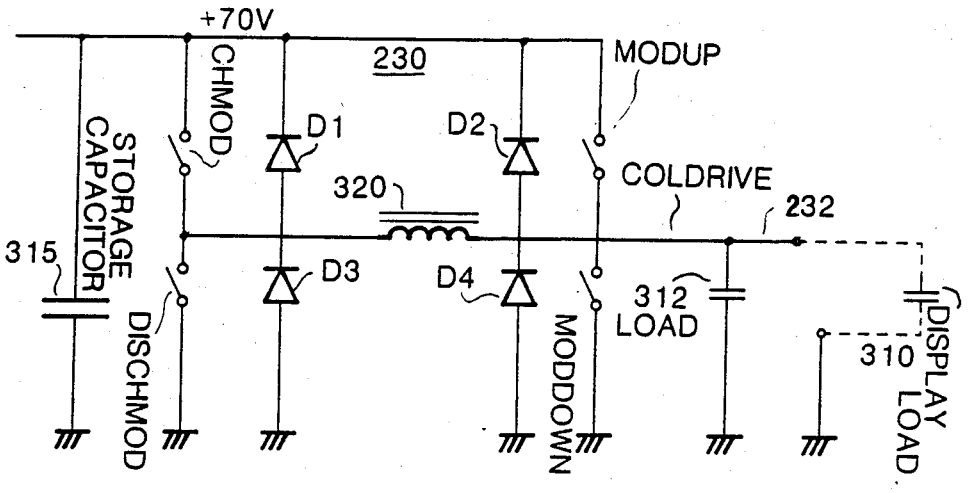
FIG. 3 shows a preferred embodiment of the column drive circuit.
Figures 4A, 4B, 4C:
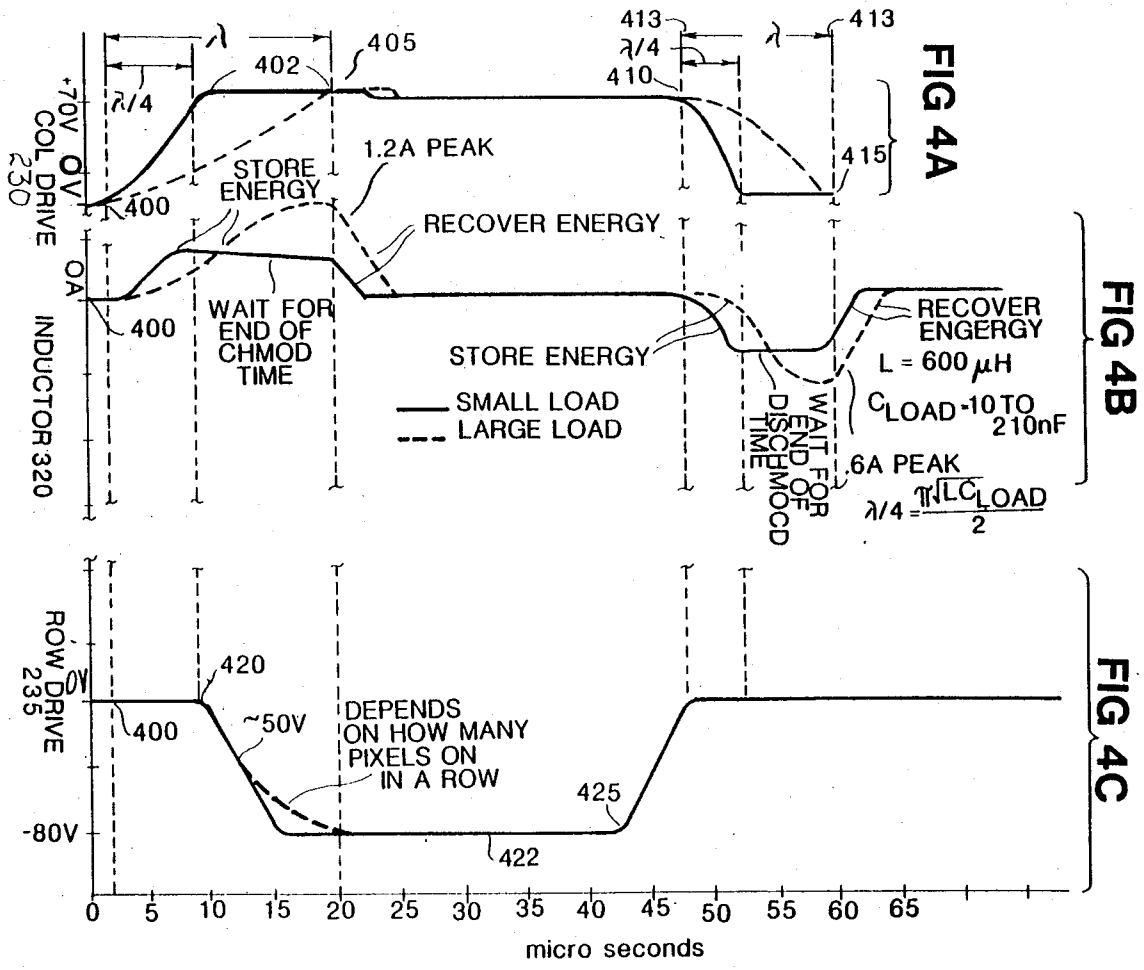
FIG. 4A–4C show the waveforms during operation of the column and row drive circuits shown in FIGS. 2, 3 and 5.

The basic theory of operation behind the column drive circuit 230, as shown in FIG. 3, is to resonantly charge the equivalent capacitive load 310 of the EL display 100. Because of the display scanning via the multiplexers 120, the equivalent capacitive load 310 is equal to the parallel combination of the matrix capacitors 240 on the column electrodes 210 which are being activated. In the preferred embodiment, the equivalent capacitive load 310 varies from 200 nanofarads when 256 columns are activated, down to less than four nanofarads when all 512 columns are activated and less than one nanofarad when no columns are activated. It should be noted that the largest equivalent display load 310 occurs when one-half of the pixels 240 are activated. Since the resonant frequency of the energy recovery circuit 230 varies as a function of the matrix capacitance, an external capacitor 312 (e.g. 10 nanofarads) is added in parallel with the display load 310 to set the maximum frequence of resonant oscillation. Resonant charging of the display load 310 is accomplished by transferring energy stored in the output capacitor 315 of the high voltage supply 107 to the display load 310 by using an inductor 320 as the transfer mechanism. The inductor 320, which in the preferred embodiment is approximately 600 microhenries, is selected so that $\frac{1}{4}$ of the resonant period of the drive circuit is short enough to completely charge the display while still leaving sufficient pulse width to light the pixels 205 and permit scanning of all of the row electrodes 210 of the entire matrix at a rate high enough to avoid flicker in the display (i.e., 60 to 70 hertz). The column drive circuit 230 consists of four high voltage switches CHMOD, DISCHMOD, MODUP, and MODDOWN. The operation of the circuit proceeds as follows and shown in FIGS. 4A through 4C: The voltage on the display load 310 starts at zero volts. When the CHMOD switch is closed at time 400, energy will flow from the storage capacitor 315 into the resonant inductor 320 and the load capacitance 310. Because of the resonant nature of the circuit, which has a natural frequency Lambda proportional to the product of the inductance L of the resonant inductor 320 times the capacitance $C_{load}$ of the display load 310 in parallel with the external capacitor 312, the voltage on the load capacitance 310 rises sinusoidally toward a peak voltage of twice the supply voltage (i.e., 2×70 V). When the voltage on the load capacitor 310 reaches 70 V the diode D2 will become forward biased and clamp the load voltage at 70 V. As shown in FIGS. 4A and 4B, this occurs at a point 402 which is a time after point 400 that is equal to $\frac{1}{4}$ of the natural frequency Lambda of the resonant circuit. At this point 402 the energy that was removed from the storage capacitor 315 is $C_{load}\times(70)^2$ and $\frac{1}{2}$ of that energy is stored in the inductor 320 and the other $\frac{1}{2}$ is stored in the display load capacitance 310 in parallel with the external capacitor 312. Shortly after diode D2 begins to conduct the CHMOD switch is opened at time 405. When this occurs diode D3 will become forward biased and the energy stored in the resonant inductor 320 will be restored in the storage capacitor 315 making the total energy removed from storage capacitor 315 $\frac{1}{2}$ $C_{load}\times(70)^2$ which is still stored in the display load capacitance 310 in parallel with the external capacitor 312. The display capacitance voltage will be kept at 70 V for as long as it is necessary to light the addressed line of pixels 205. Then at point 410 the MODUP switch will be opened and the DISCHMOD switch will be closed. In this state the energy stored in the load capacitance 310 and the external capacitor 312 will be transferred to the resonant inductor 320 until diode D4 clamps the load voltage at zero volts, which occurs at a point 413 which is a time $\frac{1}{4}$ Lambda after point 410. Sometime after the voltage on the load capacitance 310 reaches ZERO VOLTS (i.e., point 415), MODDOWN is closed and DISCHMOD is opened. The diode D1 will be forward biased and the $\frac{1}{2}$ $C_{load}\times(70)^2$ of energy stored in the resonant inductor 320 will be returned to the storage capacitor 315 making the total energy removed from the storage capacitor 315, and hence from the high voltage power supply 107, equal to zero.

The purpose of the MODUP switch is to supply the small but not insignificant energy to keep the display 100 charged to 70 V and to prevent the circuit from further oscillations. The purpose of the MODDOWN switch is essentially the same.

The foregoing description describes the circuits ideal operation. However, there are some losses of energy which are not prevented by the present invention so that in fact the total energy removed from the storage capacitor 315 is not zero. A small percentage of the energy on the order of 1% to 5% actually goes to produce light. However, the major contributor to the loss of energy is the DC resistance in series with the load capacitance 310, which is due to the high resistance, tyically about 8 kohms, of each of the column electrodes 210 in the typical display 100 and cannot be recovered even with a resonant drive circuit. In the preferred embodiment which has 512 column electrodes 210, the series resistance varies from 8 kohms when only one column is lit, down to about 30 ohms when 256 columns are lit. The result is that even with the use of minimum length pulses to charge the matrix capacitors 240, 5 to 10 watts of energy is dissipated in the column electrodes 210. Nonetheless, this is a substantial improvement over a non-resonant drive scheme in which considerable energy would in addition be lost in the column drive circuitry.

Figure 5:
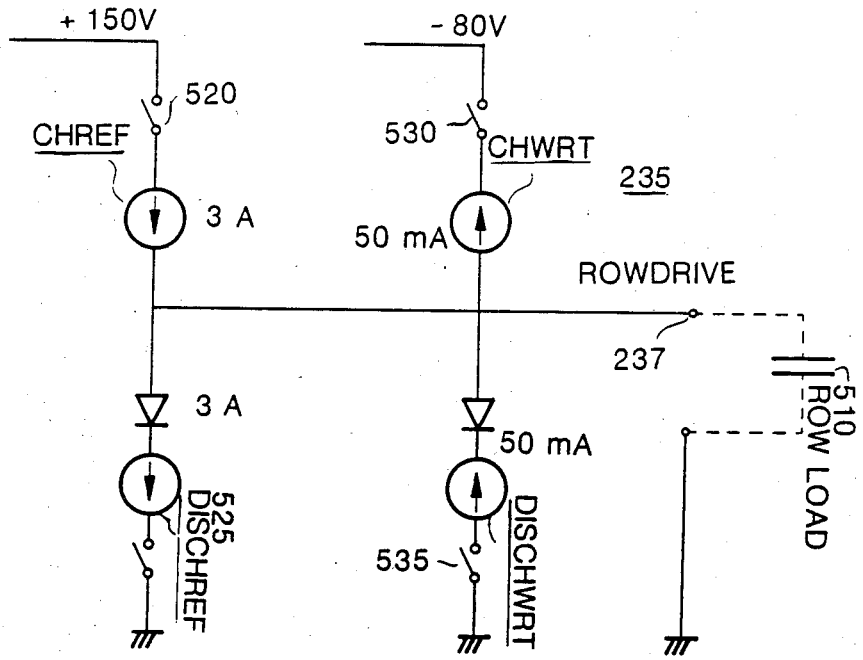
FIG. 5 shows a preferred embodiment of the row drive circuit.

As shown in FIG. 5, the row drive circuit 235 consists of four switched current sources CHREF, DISCHREF, CHWRT, and DISCHWRT. Two of the switched current sources CHREF and DISCHREF are used to provide a Refresh pulse to all of the pixels 205 all at once, one time per frame, to complete an AC voltage cycle. The other two switched current sources CHWRT and DISCHWRT are used to create write voltage pulses to light the pixels 205 in cooperation with the column drive pulses.

The write voltage cycle on the rows 237 operates synchronized with the operation of the column drive circuit 230 as shown in FIGS. 4A and 4C and the write voltage charges the display capacitance 510 to −80 V by closing the CHWRT switch 530 at time 420. The pixels 205 emit light during period 422 when the voltage between the column electrodes 210 and the row electrodes 215 exceed the pixel threshold voltage of about 120 V. The row capacitance 510 is then discharged by opening the CHWRT switch 530 and closing DISCHWRT switch 535 at time 425.

Figures 4D, 4E:
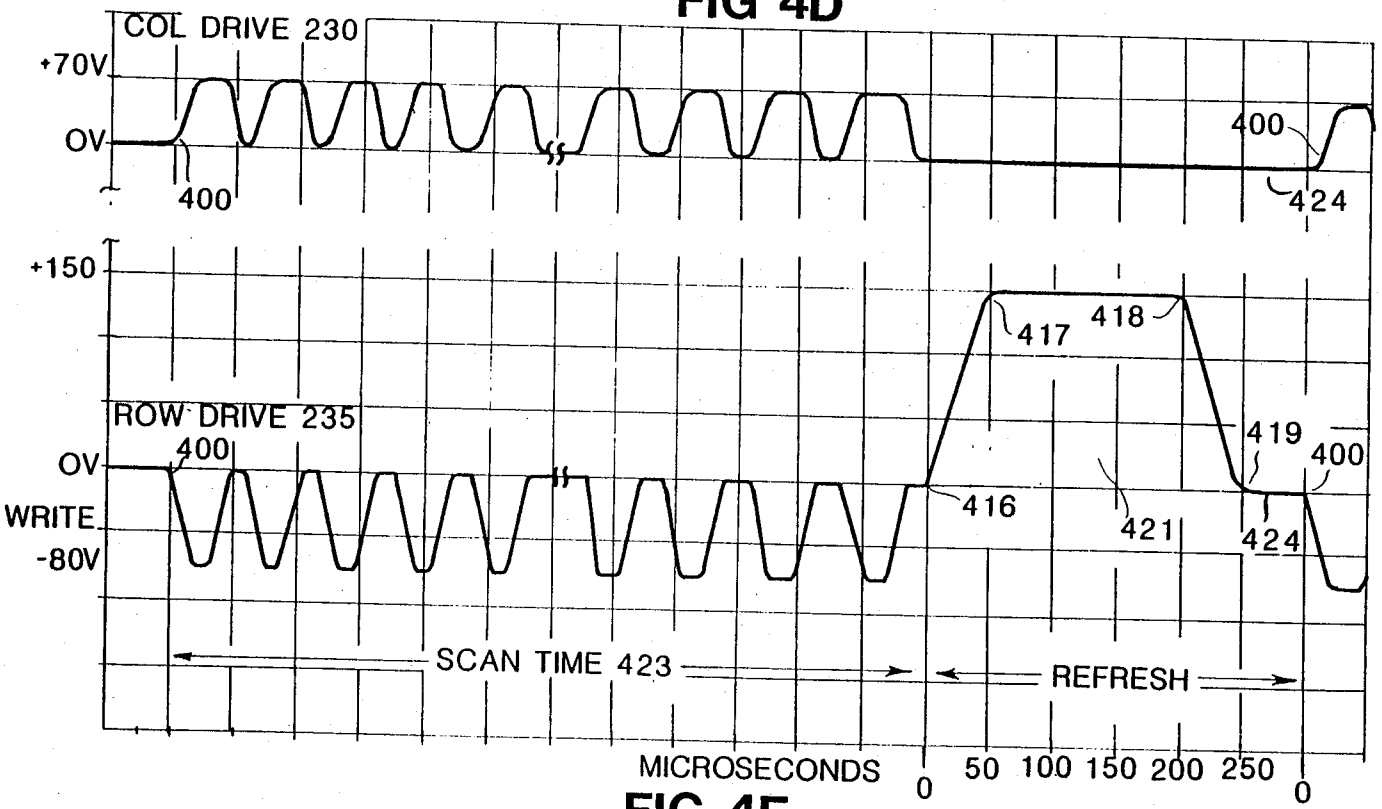
FIGS. 4D and 4E show the waveforms during operation of the column and row drive circuits shown in FIGS. 2, 3 and 5 during a scan and refresh period of the EL display.

As shown in FIGS. 4D and 4E, the refresh voltage pulse 421 occurs at the end of the scan time 423 (typically 15.5 milliseconds for 256 rows) of the frame. The CHREF switch 520 is closed at point 416 and the equivalent row capacitance 510 is charged up to +150 volt to point 417 in about 50 microseconds. CHREF switch 520 is left closed to keep the refresh voltage of +150 volts on the pixels 205 for about 150 microseconds. Then at point 418 the CHREF switch 520 is opened and the DISCHREF switch 525 is closed and the row capacitance 510 is discharged to 0 V at point 419 in about 50 microseconds. The actual time required for the refresh cycle is thus about 250 microseconds. A short wait time 424 of 50 microseconds is provided before a new frame is begun again at point 400.

Switched current sources are used to drive the row electrodes 215 so that the rate of voltage change on the row electrodes 215 can be precisely controlled. The reason that two groups of switched current sources are used for the Refresh pulse and the write voltage cycle on the rows 237 is that they each source different magnitudes of current (i.e., three amps for the refresh cycle and 50 milliamps for the write cycle) and they also source current into the row electrodes 215 in different directions. In contrast with the column electrodes 210, very little energy is lost in the row electrodes 215. This is because: the equivalent capacitance connected to the row electrodes 215 is much smaller than the capacitance connected to the column electrodes 210 during the write voltage period. Thus, in the preferred embodiment only about one watt is dissipated in the write drive electronics. While the equivalent capacitance 510 seen by the row electrodes 215 during the refresh time 421 is relatively large (e.g., 1 microfarad), the power dissipated during a refresh is small because a refresh pulse 421 is used only once per frame. Thus, in the preferred embodiment a resonant drive circuit for the rows has not been used as for the columns since the energy lost in the switched current sources (typically about 3½ watts) is not a significant percentage of the total energy being dissipated (typically 20–25 watts).

What is claimed is:

1. A display drive system for driving a display having a matrix of pixels addressed by a plurality of column and row electrodes, said display drive system comprising:

a column multiplexer having a column drive input signal line and a plurality of column drive output signal lines, said plurality of column drive output signal lines coupled to the plurality of column electrodes; and column drive means coupled to the column drive input signal line for forming a resonant tank with the plurality of column electrodes and for driving the pluralilty of column electodes with pulses of current started and stopped at ¼ wavelength intervals of the resonant period Lambda of the resonant tank, the column drive means having a first switch and a first diode coupled in parallel with each other, a second switch and a second diode coupled in parallel with each other, and directly connected in series at a first switch node with the parallel combination of the first switch and the first diode, a third switch and a third diode coupled in parallel with each other, a fourth switch and a fourth diode coupled in parallel with each other, and directly connected in series at a second switch node with the parallel combination of the third switch and the third diode, and an inductor coupled between the first and second switch nodes.

2. A display drive system as in claim 1 further comprising:

a row multiplexer having a row drive input signal line and a plurality of row dirve output signal lines, said plurality of row drive output signal lines coupled to the plurality of row electrodes; and row drive means coupled to the row drive input signal lines for driving the plurality of row electrodes with pulses of energy.

3. A display drive system as in claim 2 wherein the pulses of current for driving the plurality of row electrodes comprise nonresonant current pulses.

4. A display drive system as in claim 2 wherein the row drive means comprises:

first and second current sources, of a first value of current, both being switchable on and off;

third and fourth current sources, of a second substantially greater value of current, both being switchable on and off;

said first and second current sources coupled in series to each other to insert and withdraw current, respectively, of the first value at a current node; and said third and fourth current sources coupled in series to each other, and thereby being coupled in parallel with the first and second series coupled current sources, to insert and withdraw current, respectively, of the second substantially greater value, at the current node.

5. A display drive system as in claim 1 further comprising an external capacitor coupled to the column drive input signal line to set the maximum resonant frequency of the resonant tank.

6. A method for supplying energy to a display from a voltage produced by a power supply having an output storage capacitor, said display having a matrix of pixels addressed by a plurality of column and row electrodes, said column electrodes having an equivalent impedance which is capacitive, said method comprising:

closing a first switch to permit energy to flow from the output storage capacitor into a resonant inductor and the capacitive impedance of the display;

clamping the voltage on the capacitive impedance of the display when said capacitive impedance voltage is equal to the voltage of the power supply;

opening the first switch to permit the energy stored in the resonant inductor to flow back into the output storage capacitor while the energy stored in the capacitive impedance of the display is maintained by closing a second switch to light one or more of the pixels of the display;

opening the second switch and closing a third switch to permit energy stored in the capacitive impedance of the display to be transferred to the resonant inductor;

clamping the voltage on the resonant inductor when said resonant inductor voltage is equal to zero volts; and closing a fourth switch and opening the third switch to permit the energy stored in the resonant inductor to flow back into the output storage capacitor.

7. A display drive system for driving a display comprising:

a first switch and a first diode coupled in parallel with each other;

a second switch and a second diode coupled in parallel with each other, and directly connectd in series at a first switch node with the parallel combination of the first switch and the first diode;

a third switch and a third diode coupled in parallel with each other;

a fourth switch and a fourth diode coupled in parallel with each other, and directly connected in series at a second switch node with the parallel combination of the third switch and the third diode; and an inductor coupled between the first and second switch nodes.

8. A display drive system as in claim 7 wherein the display is comprised of a matrix of pixels addressed by a plurality of column and row electrodes, said second switch node is coupled to the column electrodes, and wherein the display has an equivalent impedance which is capacitive and said capacitive impedance and the inductor form a resonant tank having a resonant period Lambda.

9. A display drive system as in claim 8 wherein the first and second switches are switched to start and stop current flowing into the display at $\frac{1}{4}$ wavelength intervals of the resonant period Lambda.

10. A display drive system as in claim 8 further comprising an external capacitor coupled to the second switch node to set the maximum resonant frequency of the resonant tank.

* * * * *